US008166600B2

(12) United States Patent
Lee

(10) Patent No.: US 8,166,600 B2
(45) Date of Patent: May 1, 2012

(54) TOOTHBRUSH FOR PET DOG

(76) Inventor: Byung-Taek Lee, Gyeonggi-do (KR)

( * ) Notice: Subject to any disclaimer, the term of this patent is extended or adjusted under 35 U.S.C. 154(b) by 860 days.

(21) Appl. No.: 12/289,277

(22) Filed: Oct. 23, 2008

(65) Prior Publication Data

US 2010/0101036 A1 Apr. 29, 2010

(51) Int. Cl.
*A46B 9/04* (2006.01)

(52) U.S. Cl. ..... 15/167.1; 433/1

(58) Field of Classification Search ..... 15/167.1–167.2; D4/104–107, 110; 433/1; 119/615
See application file for complete search history.

(56) References Cited

U.S. PATENT DOCUMENTS 2,273,207 A * 2/1942 Kuhn ..... 15/167.1
4,731,896 A * 3/1988 de La Tour ..... 15/106
5,072,481 A * 12/1991 Weyer ..... 15/167.2
5,325,560 A * 7/1994 Pavone et al. ..... 15/106
6,408,477 B1 * 6/2002 Culbreth ..... 15/167.1
6,453,501 B1 * 9/2002 Bella ..... 15/106
2002/0083539 A1 7/2002 Bella
2007/0101946 A1 * 5/2007 Penny ..... 119/709

* cited by examiner

*Primary Examiner* — Laura C Guidotti
(74) *Attorney, Agent, or Firm* — Robert E. Bushnell, Esq.

(57) ABSTRACT

A toothbrush for a pet dog is disclosed, in which a groove is longitudinally formed in a center of a head in a direction of a handle, and a cushion material is provided in a surrounding surface, a lower surface and the groove. When a pet dog bites a toothbrush with teeth during a tooth brushing, it is possible to prevent teeth from fracture while preventing a lot of pain occurring when teeth collide with a hard toothbrush. Toothbrush hairs planted in a head are shaped depending on a tooth shape of a pet dog, so it is possible to reliably brush off plague attached on the upper side of a cervical ridge of premolars and molars of a pet dog without applying over stimulation on the gum.

6 Claims, 14 Drawing Sheets

TOOTHBRUSH FOR PET DOG

BACKGROUND OF THE INVENTION

1. Technical Field

The present invention relates to a toothbrush for a pet dog, and in particular to a toothbrush for a pet dog in which a groove is longitudinally formed in a center of a head in a direction of a handle, and a cushion material is provided in a surrounding surface, a lower surface and the groove. When a pet dog bites a toothbrush with teeth during a tooth brushing, it is possible to prevent teeth from fracture while preventing a lot of pain occurring when teeth collide with a hard toothbrush. Toothbrush hairs planted in a head are shaped depending on a tooth shape of a pet dog, so it is possible to reliably to remove the plague attached on the upper side of a cervical ridge of maxillomandibular premolars and molars of a pet dog without applying over stimulation on the gum.

2. Background Art

As shown in FIG. 15, the maxillomandibular premolars and molars of a pet dog have specific crown structures depending on a cusp development of a carnivorous animal as compared to an aspect structure development of maxillomandibular premolars and molars of a human being. According to the characteristics of cusp development teeth, a groove is deeply formed between the cusps.

As shown in FIG. 16, a gingival line curvature of maxillomandibular premolars and molars of a pet dog is formed in one gingival line portion in one crown of the maxillomandibular premolars and molars of a human being, whereas two gingival line curvatures are formed in one crown.

In addition, as shown in FIG. 17, an undercut is not formed in cervical area of the maxillomandibular premolars and molars of a pet dog as compared to a human being who has an undercut in cervical area of the maxillomandibular premolars and molars.

As shown in FIG. 18, when the maxillomandibular molars are occluding with each other in a pet dog, the maxillary molars fully overlap the mandibular molars as compared to a human being in which when the maxillomandibular molars are occluding, the maxillary molars partially overlap the upper portions of the mandibular molars.

In addition, as shown in FIG. 19, the plague accumulation portions of the maxillomandibular premolars and molars of a pet dog are formed on the upper side of a height of contour of the crown in the upper side of the protruded structure of the cervical ridge, whereas the plague accumulation portions of the maxillomandibular premolars and molars of a human being are formed in a lower side of a height of contour of the crowns near the cervical ridge.

A common toothbrush might over scratch the gum of a pet dog having a poor clean state due to an anatomical structure of the teeth and gum of a pet dog which is distinguished from a human being.

In addition, a tooth brushing time should be shorter than a normal tooth brushing of a human being due to a patience of a pet dog.

If a tooth brushing time is extended or a pet dog does not like tooth brushing, the pet dog might bite the toothbrush with teeth, and the teeth collide with the hard head of the toothbrush.

So, the teeth of a pet dog might be hurt, and the teeth might be fracture.

The US patent application laid-open number US 2002/0083539A discloses a toothbrush for a pet dog in which strong hairs are planted in a head having a V-shaped groove. The strong hairs vertically planted in a horizontal surface of an upper side of a V-shaped groove brush the gum, not teeth when brushing the premolars except for the maxillary right and left fourth premolars, so the gum might be hurt by means of an over brushing.

The strong hairs are generally planted shorter. When brushing the junction portions of the molars, the bottom portions of the shorter strong hairs might collide with the lingual cusp of the occlusal surface or the head frame, so the teeth might be broken by means of a sideward pressure applied to the teeth.

The thickness and lengths of the teeth of the pet dog are different due to the kinds of pet dogs, and even in the dentulous dental arch, the thickness and the lengths of the teeth are different. So, it is impossible to use one toothbrush for multiple kinds of pet dogs.

In addition, since the shorter strong hairs are fixedly planted in the V-shaped grooves, it is needed to insert the strong hairs of the head deeper into the teeth so as to brush the maxillomandibular first premolar which is generally thin and small. In this case, over stimulation might be applied to the gum.

In case of the maxillary right and left fourth premolars relatively being large and thick and the mandibular right and left first molars, when the fixed V-shaped space is adapted, an effective brushing of the strong hairs is a lot limited due to a partial narrowness and a partial wideness.

DISCLOSURE OF THE INVENTION

Accordingly, it is an object of the present invention to provide a toothbrush for a pet dog which overcomes the problems encountered in the conventional art.

It is another object of the present invention to provide a toothbrush for a pet dog in which a groove is longitudinally formed in a center of a head in a direction of a handle, and a cushion material is provided in a surrounding surface, a lower surface and the groove. When a pet dog bites a toothbrush with teeth during a tooth brushing, it is possible to prevent teeth from fracture while preventing a lot of pain occurring when teeth collide with a hard toothbrush. In the present invention, it is possible to decrease a sideward pressure applied to the teeth when the teeth collide with the head of the toothbrush. In addition, stimulation can be minimized when a retromolar triangle and a temporal crest collide with the hard head of the toothbrush while preventing pains. It is possible to prevent a toothbrush head from moving in a direction of a soft palate and a pharynx while being away from a retromolar triangle and a temporal crest, and the strong hairs of the head are formed depending on the structure of tooth surfaces of the pet dog, so a user and a pet dog are given a lot of convenience. It is possible to effectively remove the plague accumulated in the upper sides of the cervical ridge of the maxillomandibular premolars and molars without providing over stimulation on the gum.

To achieve the above objects, in a toothbrush for a pet dog in which a head with strong hairs is installed in an end of a handle, there is provided a toothbrush for a pet dog characterized in that a circular protrusion 110*a* is formed at each corner of the head, and a circular concave part 110*b*, 110*c* is formed between the protrusions 110*a*, and a groove 101 is longitudinally formed in a center portion in a direction of a handle 120, and both sides of the groove 101 are formed of multiple shoulders 102, 103, 104, and a strong hair is installed in both sides of the groove and in each shoulder. A cushion material is installed in a surrounding surface of the head 110, a groove 101 of an upper surface, and a center of a lower surface, respectively. A strong hair of a front end of the head 110 is vertically installed, and a strong hair of an intermediate portion and a rear end is installed with their being gathered in a slanted shape. The height of a strong hair of the intermediate portion is higher than the height of the strong hair of the rear end.

Effects

In the present invention, a cushion material is installed in a head. When a pet dog bites a toothbrush with teeth during a tooth brushing, it is possible to prevent teeth from fracture while preventing a lot of pain occurring when teeth collide with a hard toothbrush. In the present invention, it is possible to decrease a sideward pressure applied to the teeth when the teeth collide with the head of the toothbrush. A stimulation can be minimized when a retromolar triangle and a temporal crest collide with the hard head of the toothbrush while preventing pains.

The strong hairs of the head are formed depending on the structure of tooth surfaces of the pet dog, so a user and a pet dog are given a lot of convenience.

With the strong hairs in which the ends are gathered in a slant direction, it is possible to effectively remove the plague accumulated in the upper sides of the cervical ridge of the premolars and the molars without giving over stimulation on the gum.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

MODES FOR CARRYING OUT THE INVENTION

The embodiments of the present invention will be described with reference to the accompanying drawings.

Figure 1:
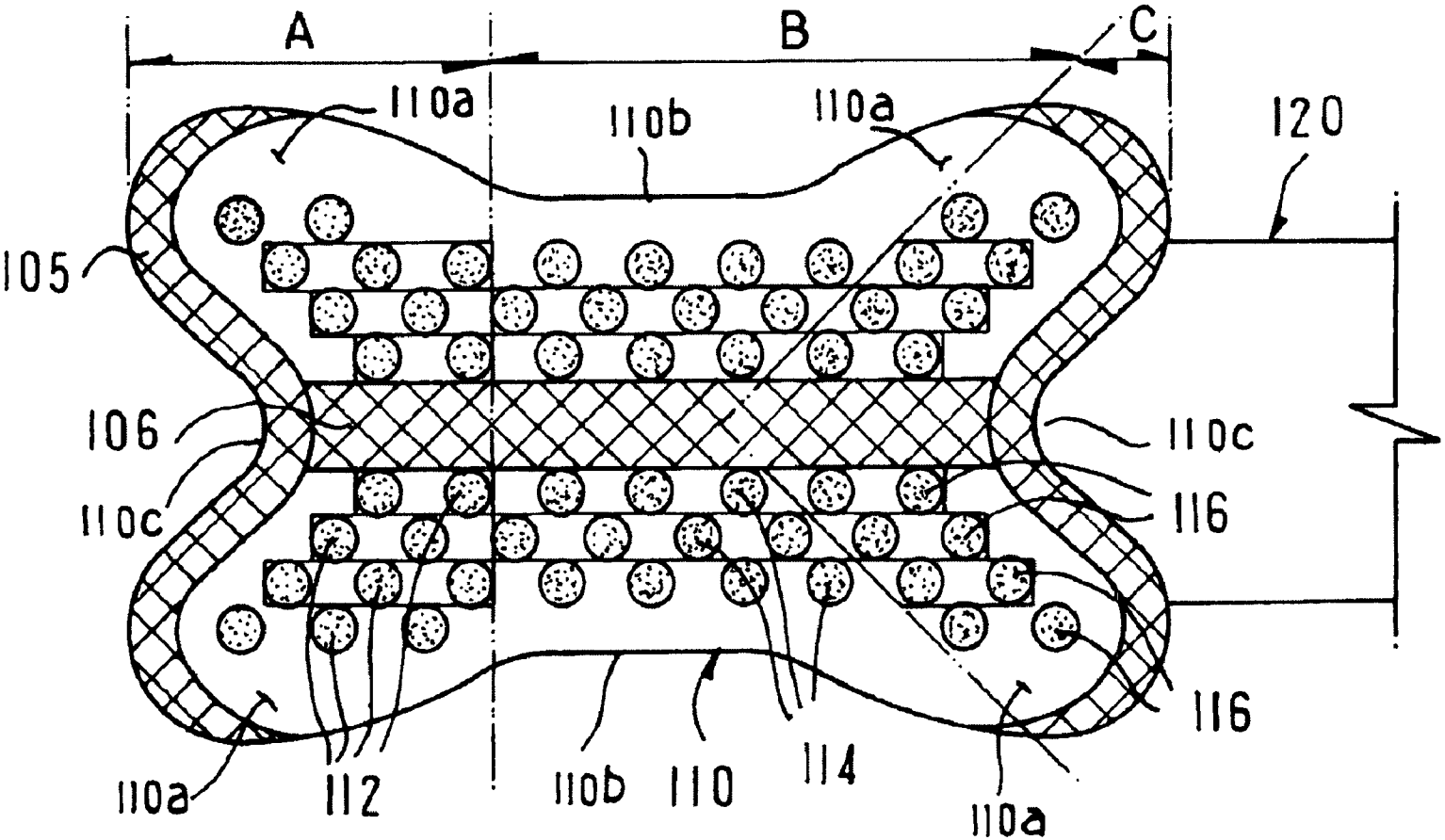
FIG. 1 is a plane view of a toothbrush head according to the present invention.
Figure 2:
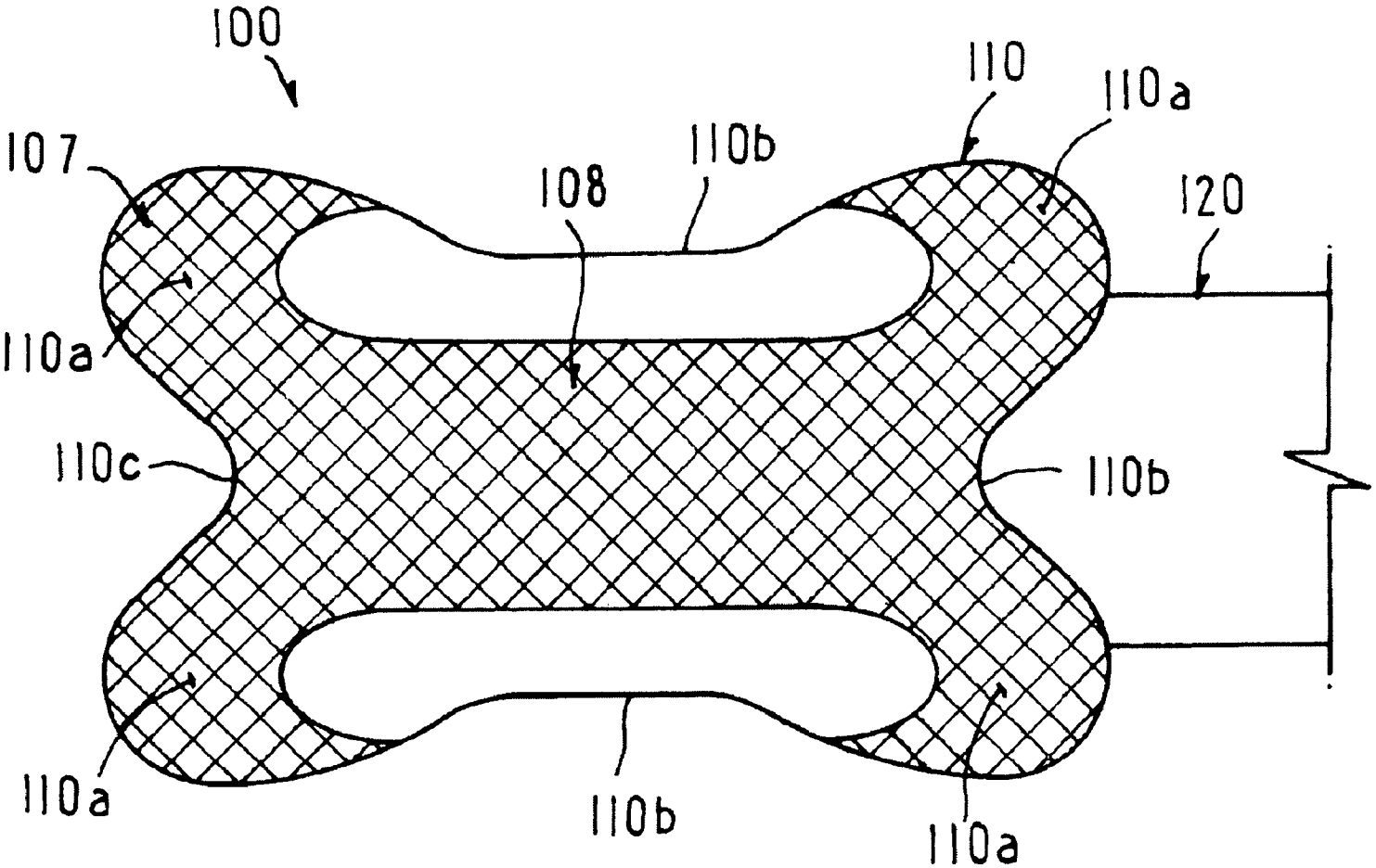
FIG. 2 is a bottom view of a toothbrush head according to the present invention.

FIGS. 1 and 2 are views illustrating a toothbrush for a pet dog according to the present invention. The pet dog body 100 comprises a head 110, and a handle 120.

The head 110 is formed of a laterally and longitudinally extended plate body, and a circular protrusion 110*a* is formed at each corner, and a first concave part 110*b* is smoothly curved and is formed in a lateral surface, and a circular second concave part 110*c* is formed in a portion which defines front and rear sides.

The protrusion 110*a* is formed at each corner, and a smoothly curved first concave part 110*b* is formed between the protrusions 110*a* which form the side surfaces, and a circular second concave part 110*c* is formed between the protrusions 110*a* which form the front and rear sides.

A groove 101 is longitudinally formed in the direction of the handle 120 in the center of the head 110, with a plurality of shoulders facing each other as the heights of the shoulders increase more and more in both sides of the groove 101.

An upper cushion 105 and a lower cushion 107 are cooperatively formed in a surrounding surface of the head 110. An upper center cushion material 106 is installed in the center of an upper cushion 105, namely, in the groove 101, and a lower center cushion material 108 is installed in a lower surface corresponding to the upper center cushion material.

Here, the cushions 105 and 107 and the upper and lower center cushion materials 106 and 108 are made of flexible rubber materials.

Figure 3:
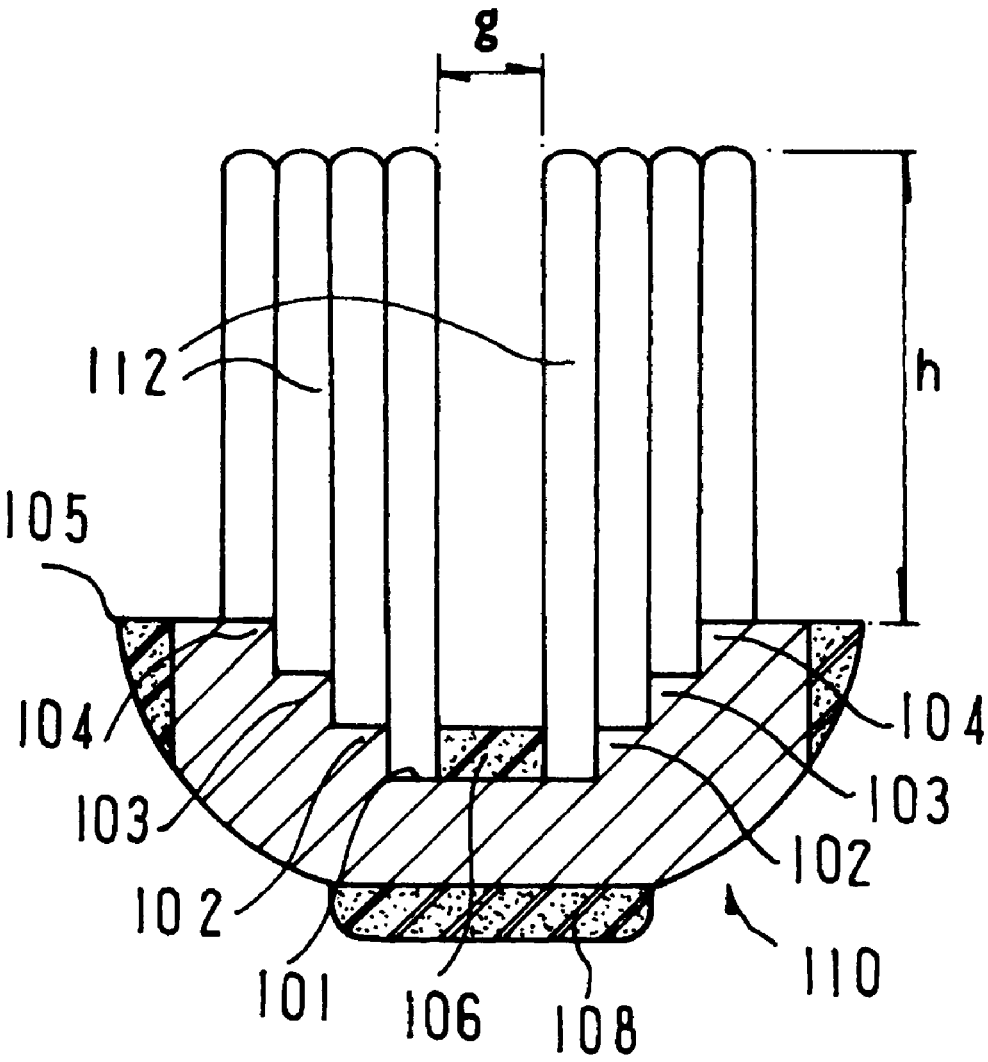
FIG. 3 is a cross sectional view of the portion A of FIG. 1.

In the shoulder formed in the front end (left side in the drawing) of the head 110 among the shoulders formed on the upper surface of the head 110, as shown in FIG. 3, a first shoulder 102 is upwardly protruded from the groove 101, and a second shoulder 103 is upwardly protruded from the first shoulder 102, and a third shoulder 104 is upwardly protruded from the second shoulder 103. They are symmetrical at both sides about the groove 101.

A first strong hair 112 is vertically installed in both sides of the groove 101 and in each shoulder 102, 103 and 104.

Figure 5:
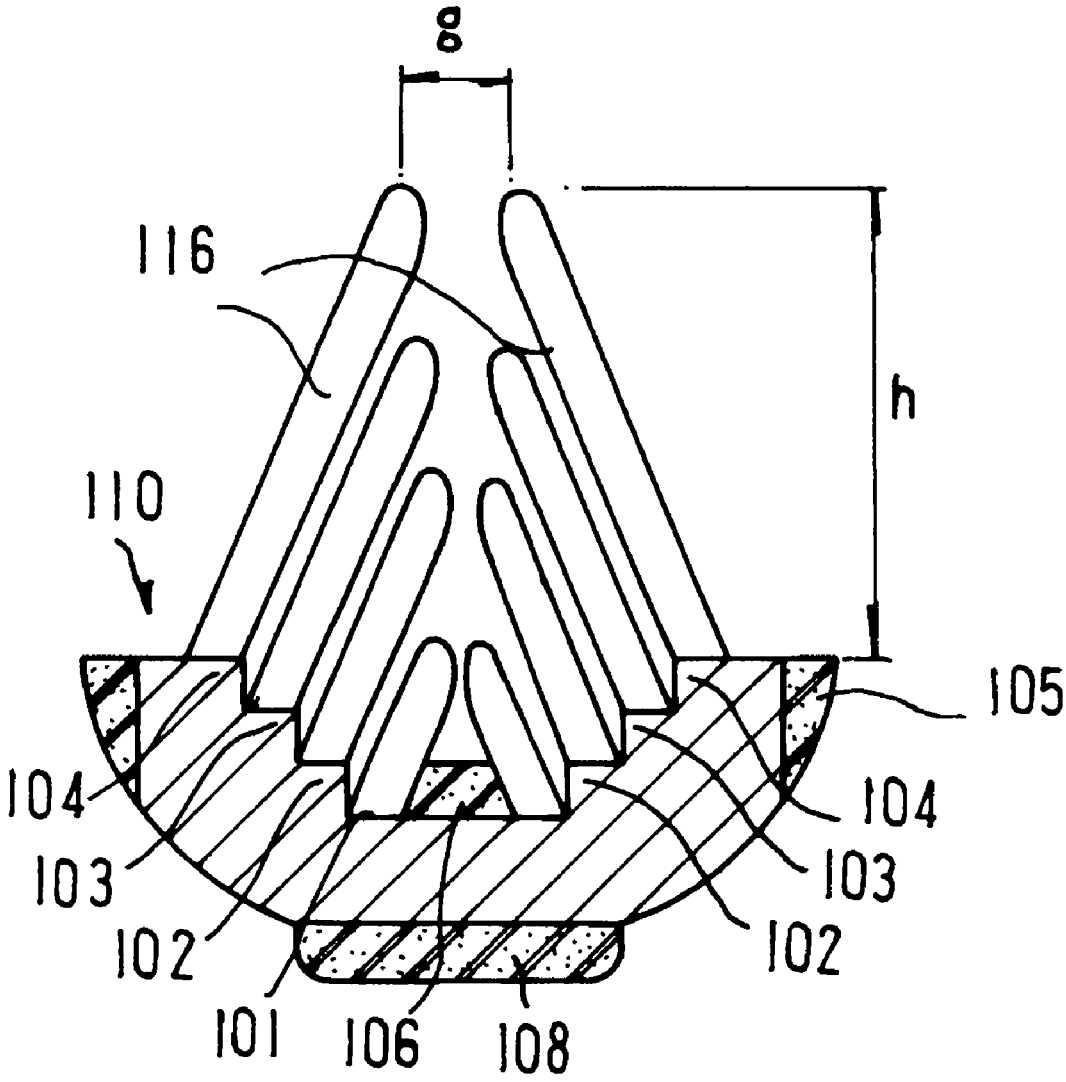
FIG. 5 is a cross sectional view of the portion C of FIG. 1.

As shown in FIG. 5, in the shoulder formed in the rear end (right side in the drawing) of the head 110, a first shoulder 102 is upwardly protruded from the groove 101, and the second shoulder 103 is upwardly protruded from the first shoulder 102, and a third shoulder 104 is upwardly protruded from the second shoulder 103, which shoulders are symmetrically formed about the groove 101.

A third strong hair 116 is installed in both sides of the groove 101 and the shoulders 102, 103 and 104 with their ends being gathered in a slanted shape.

Figure 4:
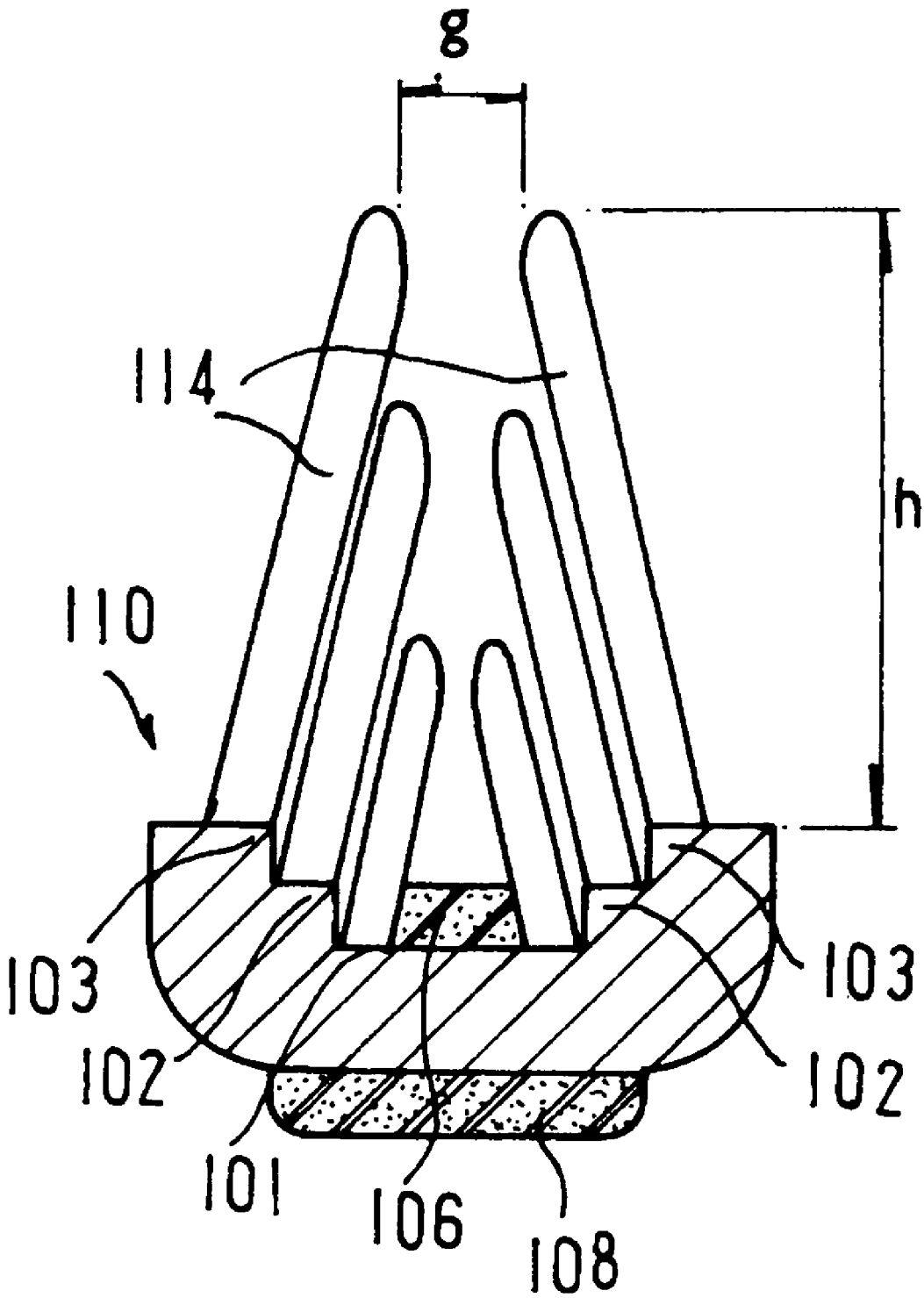
FIG. 4 is a cross sectional view of the portion B of FIG. 1.

As shown in FIG. 4, in the shoulders formed in the intermediate portions of the front and rear ends of the head 110, a first shoulder 102 is upwardly protruded from the groove 101, and a second shoulder 103 is upwardly protruded from the first shoulder 102, which shoulders are symmetrically formed in both sides about the groove 101.

A second strong hair 114 is installed in both sides of the groove 101 and in the shoulders 102 and 103 with their ends being gathered in a slanted shape.

In the above constructions, the interval (g) of the first strong hair 112, the interval (g) of the second strong hair 114, and the interval (g) of the third strong hair 116 are 2 mm, respectively. The intervals might be gradually increased depending on the size of the pet dog because the bucco lingual widths of the premolars and the molars increase in case of the large size pet dogs as compared to the small size pet dogs.

The height (h) of the first strong hair 112 is the same as the height (h) of the strong hairs of both sides of the third strong hair 116, whereas the height (h) of both ends of the second strong hair 114 is higher than the first and third strong hairs 112 and 116.

Figure 6:
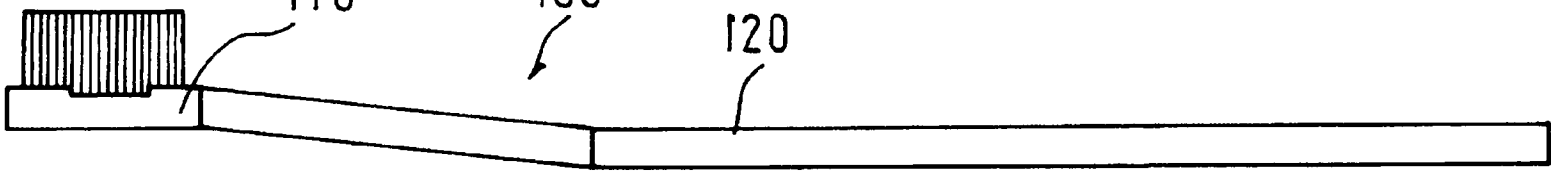
FIG. 6 is a side view of a toothbrush according to the present invention.
Figure 7:
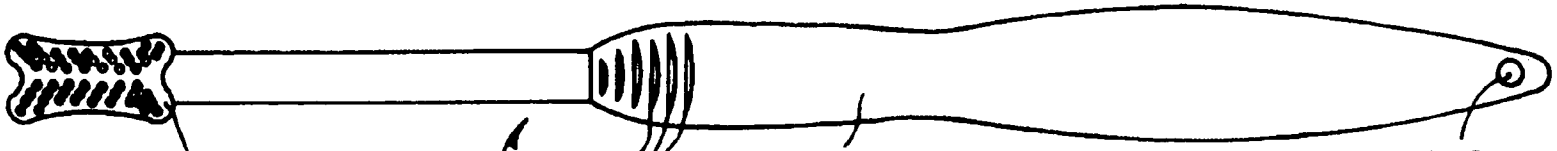
FIG. 7 is a plane view of a toothbrush according to the present invention.
Figure 8:
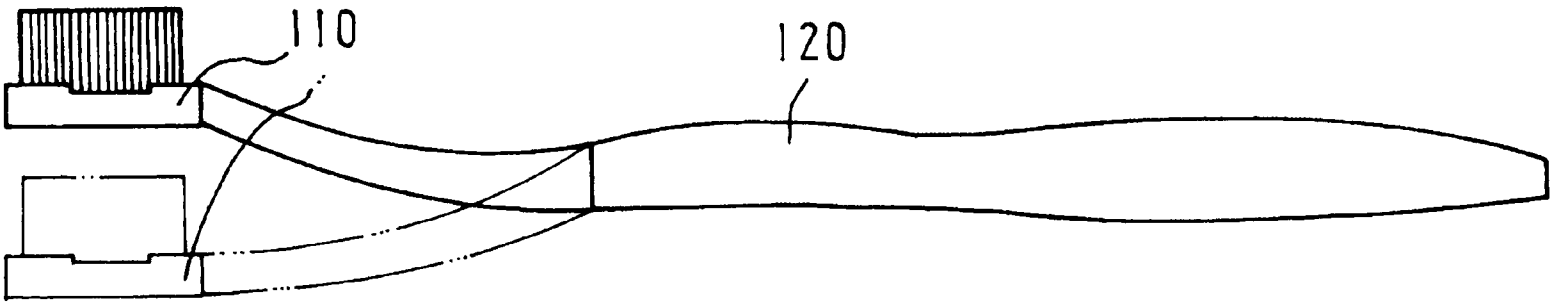
FIG. 8 is a side view of another example that a neck part can be angle-adjusted according to the present invention.

As shown in FIGS. 6 and 7, the handle 120 is so formed that the user can easily hold. A plurality of non-slip protrusions 121 are formed in the portion contacting with a user's thumb. A hanging hole 122 is formed in an end of the handle 120.

Figure 9:
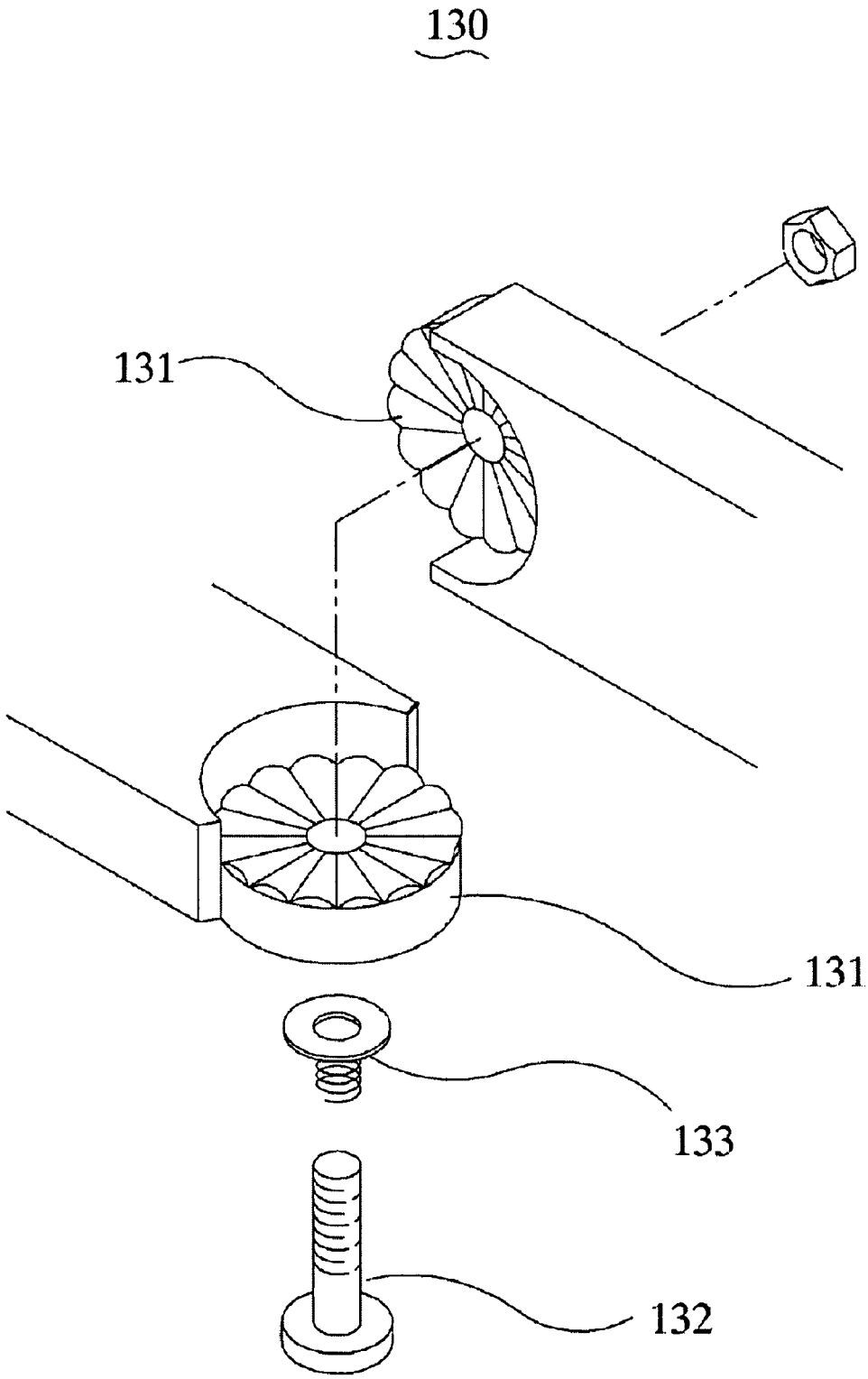
FIGS. 9 and 10 are perspective views of an embodiment of FIG. 8.
Figure 10:
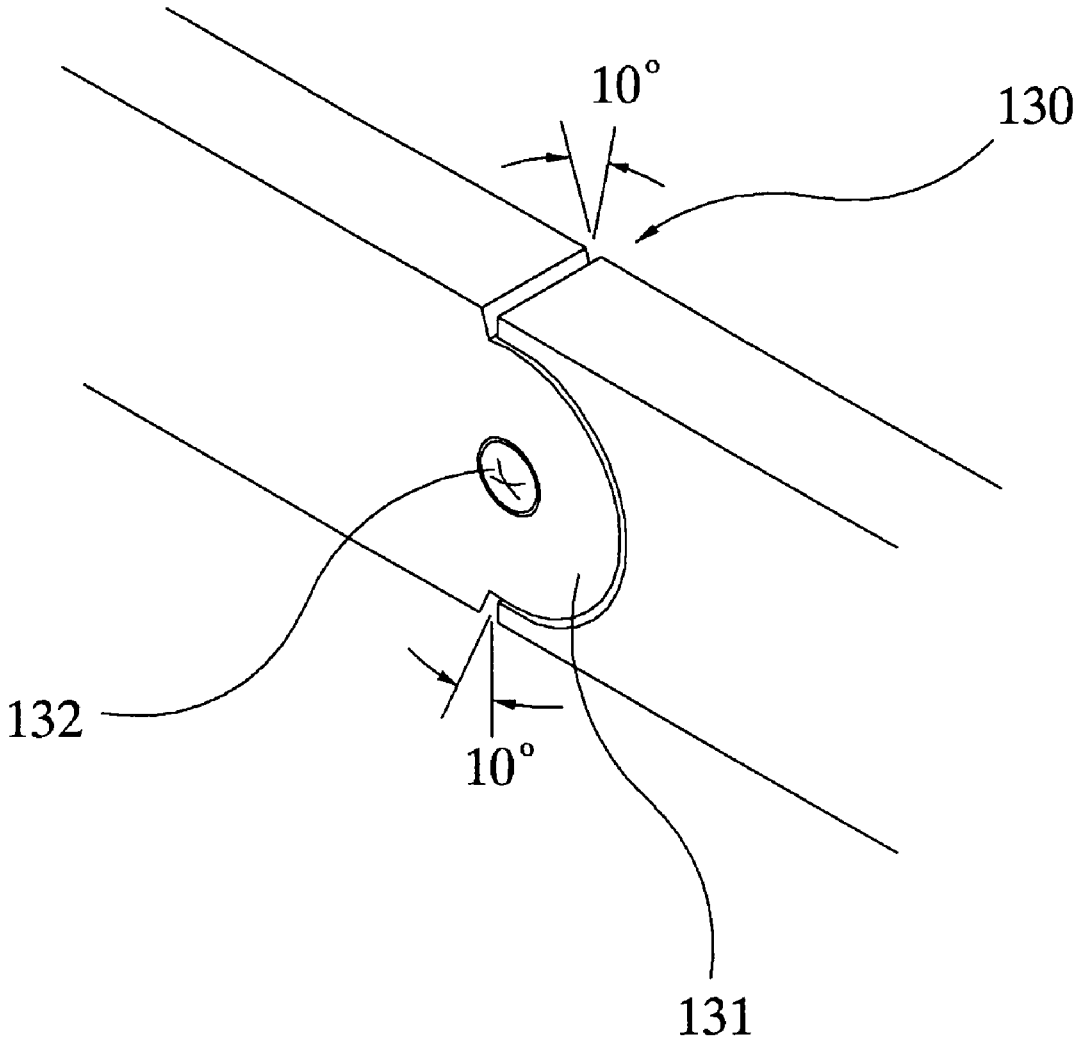

As shown in FIGS. 9 and 10, a neck part 130 connecting the head 110 and the handle 120 is equipped with an engaging angle adjusting member of which angle can be adjustable.

With the above angle adjusting function, it is possible to adjust its angle for a proper brushing of the maxillomandibular molars, and it allows a user to more unlimitedly select his position and posture.

Figure 11:
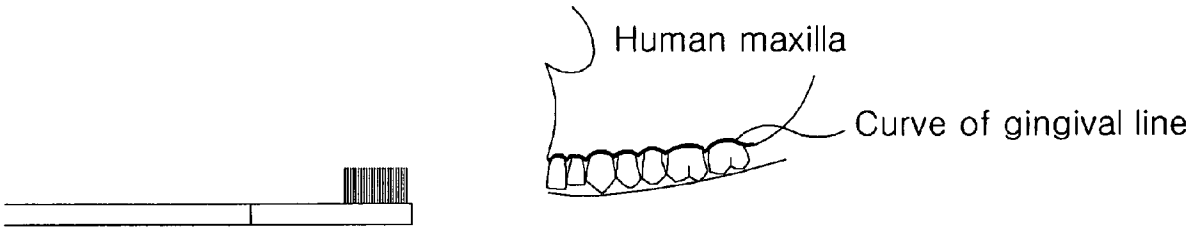
FIG. 11 is a side view of a maxilla of a human being in an embodiment of FIG. 8.

As shown in FIG. 11, a gingival line of the maxilla of the human being does not need an angle adjustment function since it is smoothly curved from the gingival line of the central incisor to the distal gingival line of the second molar. (The gingival curved line of the mandible of the human being corresponded to the curve of the gingival line of the maxilla).

Figure 12:
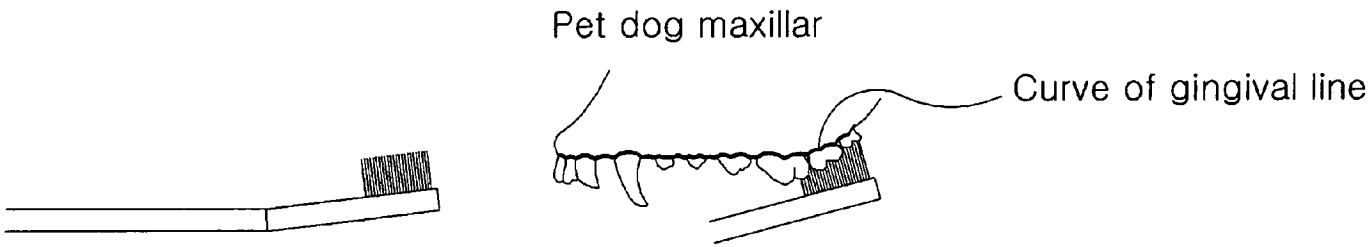
FIG. 12 is a side view of a maxilla of a pet dog in an embodiment of FIG. 8.

As shown in FIG. 12, the gingival line of the maxilla of the pet dog is a smooth curve similar to a straight line from the gingival line of the central incisor to the distal gingival line of the fourth premolar, and is slanted from the mesial gingival line of the first molar to the distal gingival line of the second molar and then rises to form a gingival line curve. When the angle of the toothbrush head is forwardly adjusted, a proper tooth brushing can be performed with respect to the molars of the maxilla.

Figure 13:
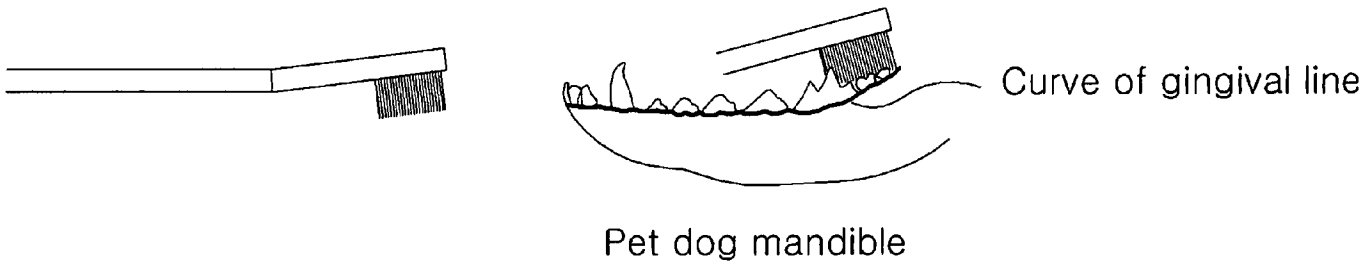
FIG. 13 is a side view of a mandible of a pet dog in an embodiment of FIG. 8.

As shown in FIG. 13, the gingival line of the mandible of the pet dog is a smooth curve similar to a straight line from the gingival line of the central incisor to distal gingival line of fourth premolar, and is slanted from the mesial gingival line of the first molar to the distal gingival line of the third molar and then rises to form a gingival line curve. When the angle of the toothbrush head is backwardly adjusted, a proper tooth brushing can be performed with respect to the molars of the mandible.

In addition, since each user has different tooth brushing postures, a certain tooth brushing posture can be unlimitedly selected, and even adult can easily toothbrush the pet dog in more free postures.

As one example of the engaging angle adjusting member, a circular engaging plate 131 is provided in the sides of the head 110 and the handle 120. The engaging protrusions are formed in the opposing surfaces of two engaging plates 131 along a circular configuration, and an engaging bolt 132 might be used for binding two engaging plates.

The engaging bolt 132 might be used along with a pressurizing spring 133, so that the angle can be easily adjusted by the force of the user as the engaging operation of the engaging plate 131 can be elastically performed.

The adjusting angle by means of the engaging angle adjusting member is preferably within 10 degrees.

In the configuration of the head 110 of the present invention, the protrusions 110*a* are formed at each corner, and the smoothly curved first concave part 110*b* is formed between the protrusions 110*a* which define the side surface, and the circular second concave part 110*c* is formed between the protrusions 110*a* which define the front and rear sides, so that it is shaped in a bone shape that the pet dog likes.

In addition, the upper cushion 105 and the lower cushion 107 are cooperatively formed along the surrounding surface of the head 110, and an upper center cushion material 106 is installed in the groove 101. A lower center cushion material 108 is installed in the lower surface. So, even when the toothbrush collides with a retromolar triangle and a temporal crest, the pet dog is not hurt. The teeth can be protected from an external (sideward pressure). Even when the pet dog bites the head 110 during the tooth brushing, the teeth are not fracture.

A first strong hair 112 is vertically installed in a front end of the head 110, and second and third strong hairs 114 and 116 are installed in the intermediate portion and the rear end in a slanted shape.

In the above constructions, the toothbrush does not slip by providing the non-slip protrusions 121 formed in the handle 120 during the tooth brushing, and the toothbrush can be hanged using the hanging hole 122.

In other words, the constructions of the toothbrush are matched with the tooth structure of the premolars with the helps of the second strong hair 114 installed in a slanted shape, and the third strong hair 116 installed in a slanted shape. The first strong hair 112, which is vertically installed, can be used when brushing the occlusal surface of the molars and the incisors (including canines).

Figure 14:
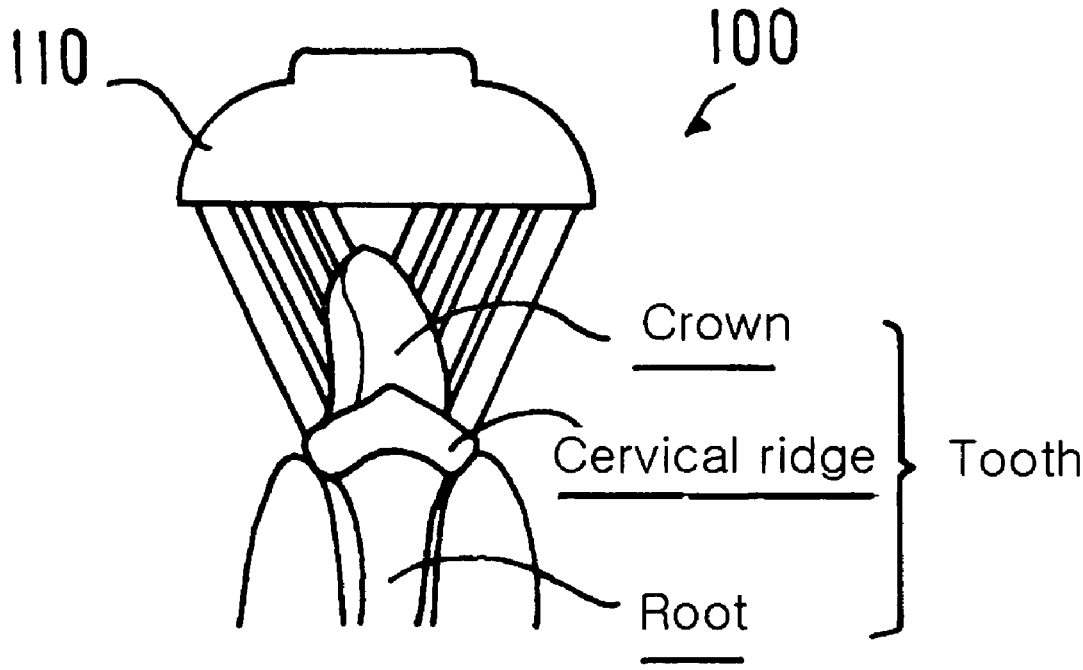
FIG. 14 is a view of a use according to the present invention.
Figure 15:
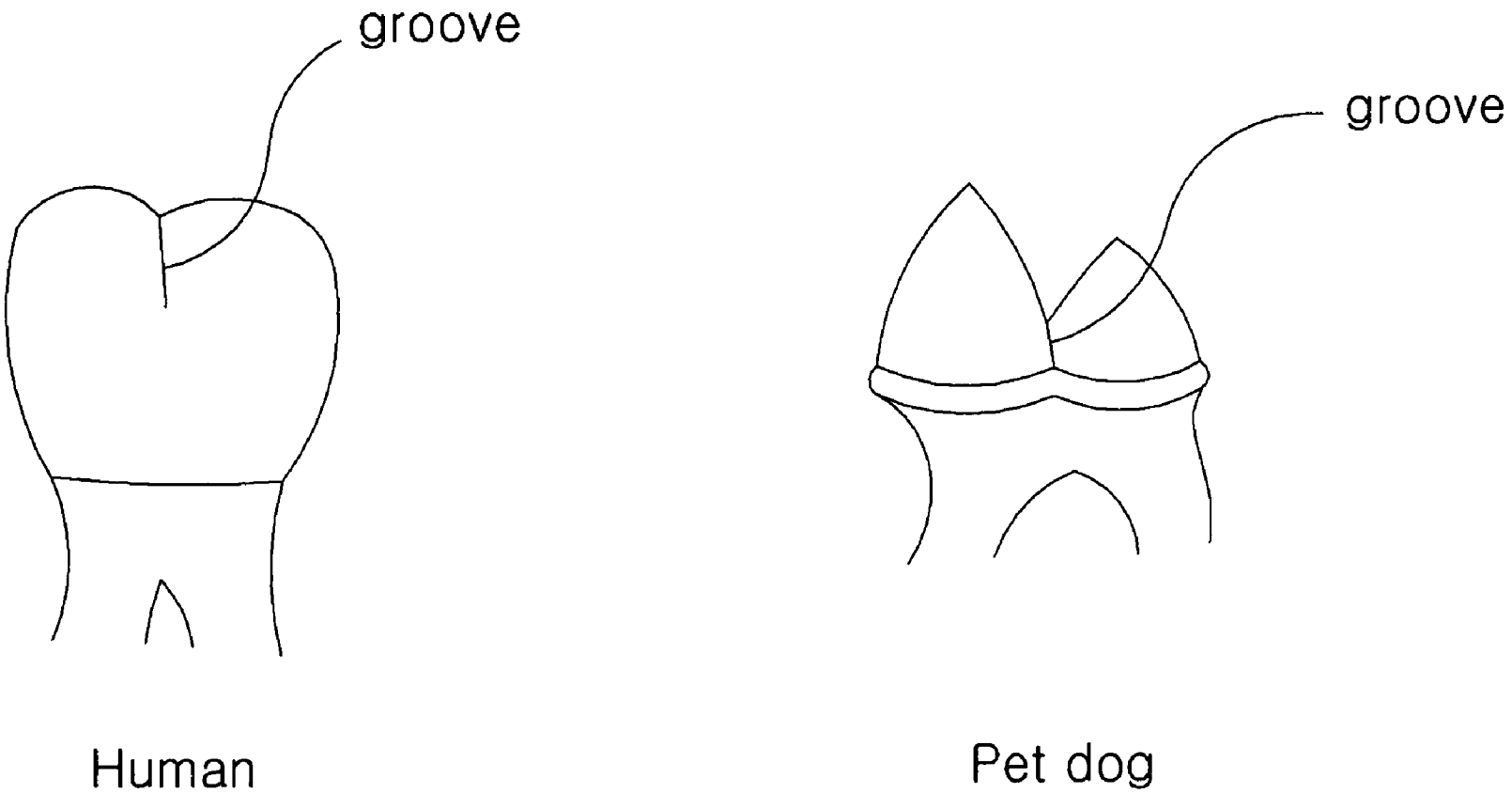
FIG. 15 is a comparison view of a tooth of a human being and a pet dog.
Figure 16:
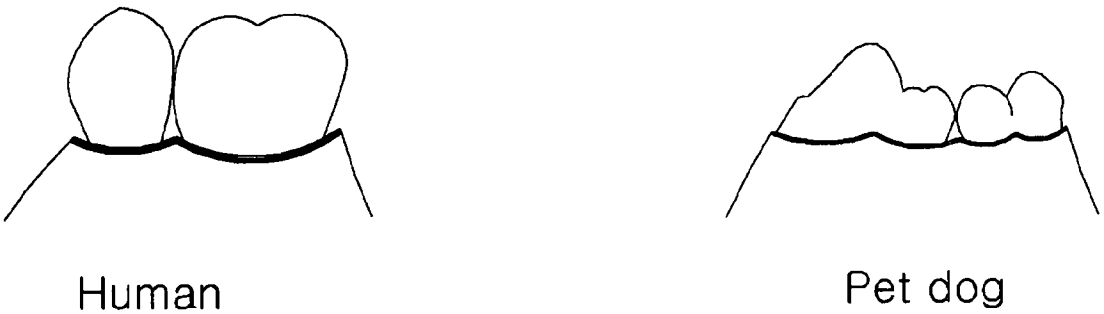
FIG. 16 is a comparison view of a gingival line of a human being and a pet dog.
Figure 17:
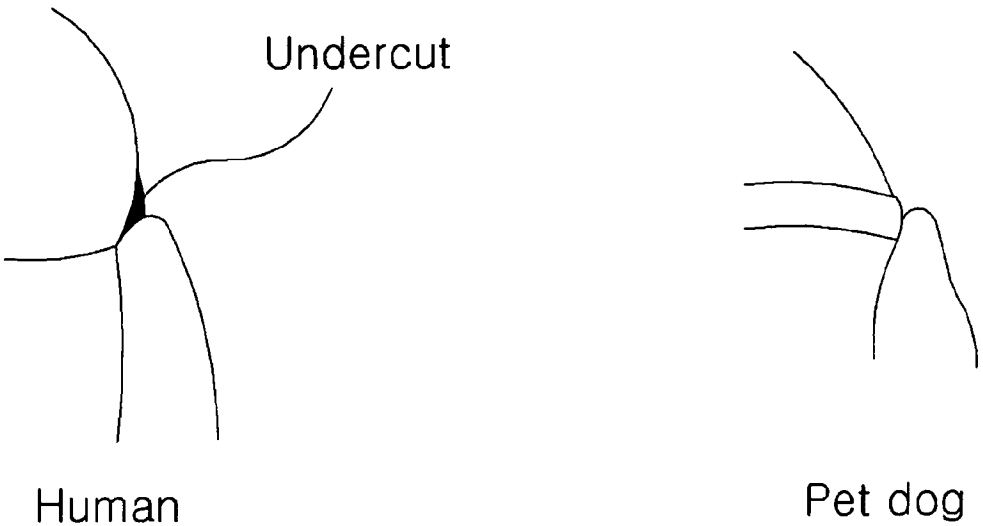
FIG. 17 is a comparison view of an undercut of a human being and a pet dog.
Figure 18:
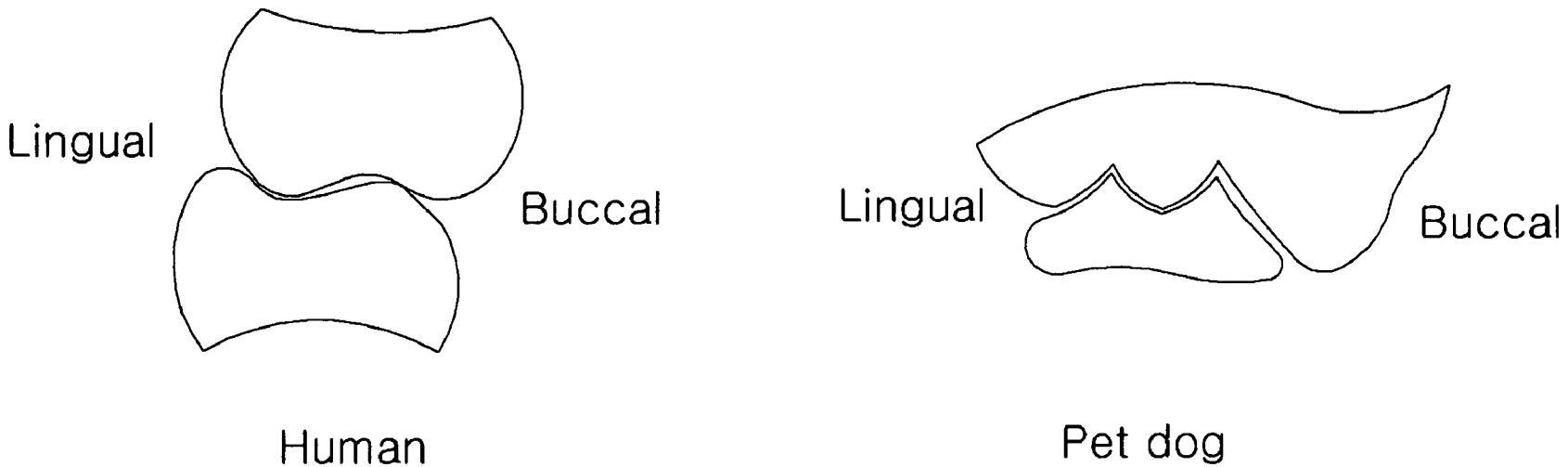
FIG. 18 is a comparison view of a tooth occluding state (occlusion) of a human being and a pet dog.
Figure 19:
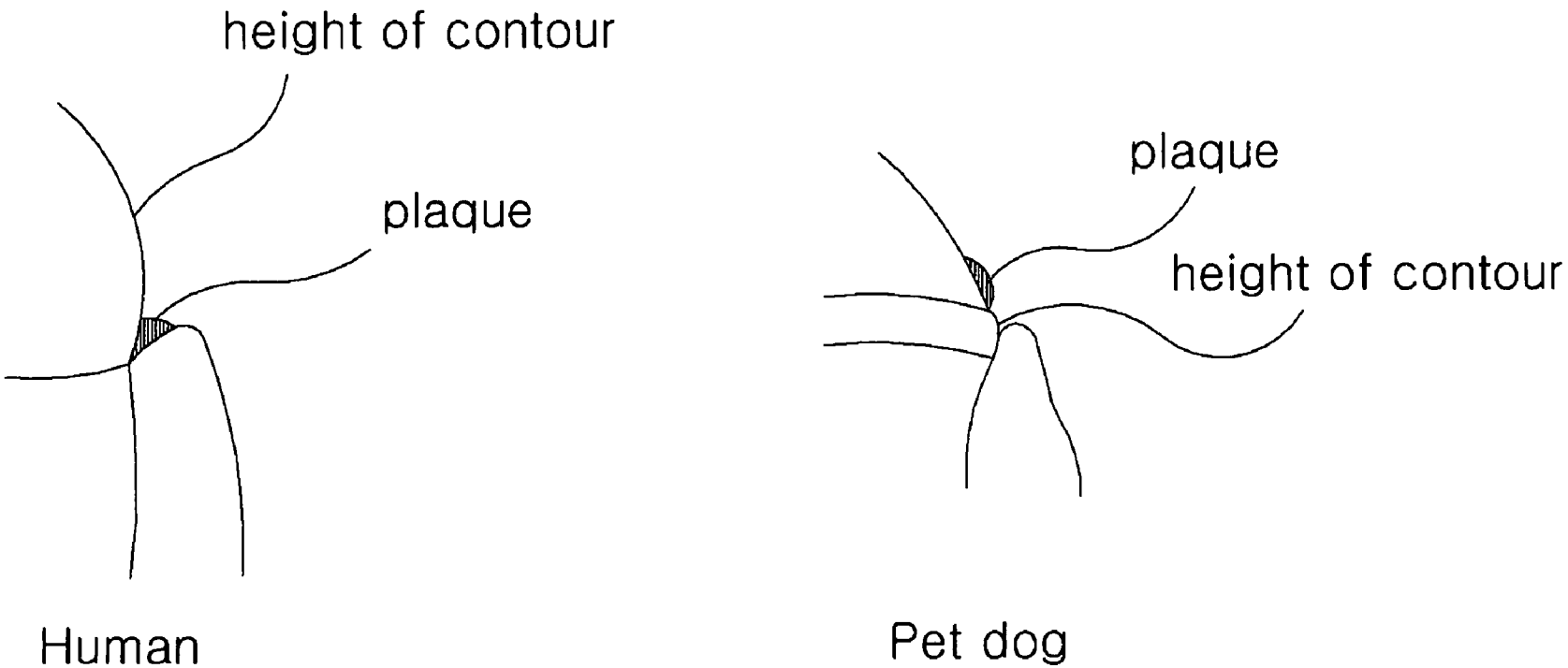
FIG. 19 is a comparison state of a plague accumulation state of a human being and a pet dog.

The first strong hair 112, the second strong hair 114 and the third strong hair 116 concurrently brush the buccal aspect, the lingual aspect and the occlusal surfaces of the upper sides of the protruded structure (cervical ridge) when brushing in the forward and backward directions toward the gum from the incisal (occlusal surface) side. As shown in FIG. 14, the second strong hair 114 and the third strong hair 116 are capable of reliably removing the plague accumulated on the upper side of the protruded portions without over stimulation on the gum As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a toothbrush for a pet dog in which a head with strong hairs is installed in an end of a handle, a toothbrush for a pet dog characterized in that a circular protrusion is formed at each corner of the head, and a circular concave part is formed between the protrusions, and a groove is longitudinally formed in a center portion in a direction of a handle, and both sides of the groove are formed of multiple shoulders, and a strong hair is installed in both sides of the groove and in each shoulder.

2. The toothbrush of claim 1, wherein a cushion material is installed in a surrounding surface of the head, a groove of an upper surface, and a center of a lower surface, respectively.

3. The toothbrush of claim 2, wherein a strong hair of a front end of the head is vertically installed, and a strong hair of an intermediate portion and a rear end is installed with their being gathered in a slanted shape.

4. The toothbrush of claim 1, wherein a strong hair of a front end of the head is vertically installed, and a strong hair of an intermediate portion and a rear end is installed with their being gathered in a slanted shape.

5. The toothbrush of claim 1, wherein the height of a strong hair of the intermediate portion is higher than the height of the strong hair of the rear end.

6. The toothbrush of claim 1, wherein a neck part connecting the head and the handle is engaged with an engaging angle adjusting means for an angle adjustment, and said engaging angle adjusting means is equipped with a circular engaging plate in the sides of the head and the handle, and an engaging protrusion is formed in the opposing surfaces of two engaging plates along a circular configuration, and an engaging bolt is provided for engaging two engaging plates, and the engaging bolt is engaged along with a pressurizing spring, so that the engagement of the engaging plate is elastically movable, and an angle can be adjustable by means of a user's force.

* * * * *